US011339487B2

(12) United States Patent
Chen et al.

(10) Patent No.: US 11,339,487 B2
(45) Date of Patent: May 24, 2022

(54) SYNERGISTIC EFFECTS OF MULTI-FACETED CU2O NANOCRYSTALS FOR ELECTROCHEMICAL CO2 REDUCTION

(71) Applicants: Honda Motor Co., Ltd., Tokyo (JP); Utah State University, Logan, UT (US)

(72) Inventors: Gugang Chen, Powell, OH (US); Yi Rao, North Logan, UT (US); Xia Li, North Logan, UT (US)

(73) Assignees: HONDA MOTOR CO., LTD., Tokyo (JP); UTAH STATE UNIVERSITY, Logan, UT (US)

( * ) Notice: Subject to any disclaimer, the term of this patent is extended or adjusted under 35 U.S.C. 154(b) by 0 days.

(21) Appl. No.: 16/800,966

(22) Filed: Feb. 25, 2020

(65) Prior Publication Data

US 2020/0277703 A1 Sep. 3, 2020

Related U.S. Application Data

(60) Provisional application No. 62/811,708, filed on Feb. 28, 2019.

(51) Int. Cl.

| | |
|---|---|
| ***C25B 3/25*** | (2021.01) |
| ***C25B 11/077*** | (2021.01) |
| ***C25B 9/17*** | (2021.01) |

(52) U.S. Cl.

CPC ..... *C25B 11/077* (2021.01); *C25B 3/25* (2021.01); *C25B 9/17* (2021.01)

(58) Field of Classification Search

None

See application file for complete search history.

(56) References Cited

U.S. PATENT DOCUMENTS

| | | | |
|---|---|---|---|
| 5,252,355 | A | 10/1993 | Ando et al. |
| 6,921,712 | B2 | 7/2005 | Soininen et al. |

(Continued)

FOREIGN PATENT DOCUMENTS

| | | |
|---|---|---|
| CN | 103042231 | 4/2013 |
| CN | 102502772 | 12/2013 |

(Continued)

OTHER PUBLICATIONS

Machine translation of Chinese Office Action and Search Report of CN201810859393.X dated Nov. 10, 2021 (Year: 2021).*

(Continued)

*Primary Examiner* — Wojciech Haske

(74) *Attorney, Agent, or Firm* — Mark E. Duell; Rankin, Hill & Clark LLP

(57) ABSTRACT

A method of electrochemical reduction of carbon dioxide includes the use of multi-faceted $Cu_2O$ crystals as a catalyst to convert $CO_2$ to value-added products. An electrochemical cell for the electrochemical reduction of carbon dioxide includes a cathode including the multi-faceted $Cu_2O$ crystals. The multi-faceted $Cu_2O$ crystals have at least two different types of facets with different Miller indices. The multi-faceted $Cu_2O$ crystals include steps and kinks present at the transitions between the different types of facets. These steps and kinks improve the Faradaic Efficiency of the conversion of carbon dioxide. The multi-faceted $Cu_2O$ crystals may be nanosized. The multi-faceted $Cu_2O$ crystals may include 18-facet, 20-facet, and/or 50-facet $Cu_2O$ crystals.

20 Claims, 9 Drawing Sheets
(7 of 9 Drawing Sheet(s) Filed in Color)

(56) References Cited

U.S. PATENT DOCUMENTS

| | | | | |
|---|---|---|---|---|
| 8,900,659 | B2 | 12/2014 | Zeng et al. | |
| 2004/0221685 | A1 | 11/2004 | Jeong et al. | |
| 2006/0235087 | A1 | 10/2006 | Alexandridis et al. | |
| 2014/0060639 | A1 | 3/2014 | Zeira et al. | |
| 2015/0136613 | A1* | 5/2015 | Li | C25B 11/077 205/555 |
| 2015/0259305 | A1 | 9/2015 | Huang et al. | |
| 2018/0119296 | A1 | 5/2018 | Geioushy et al. | |
| 2019/0202762 | A1* | 7/2019 | Wu | B01J 27/051 |

FOREIGN PATENT DOCUMENTS

| | | |
|---|---|---|
| CN | 105879887 | 8/2016 |
| CN | 106378141 | 2/2017 |

OTHER PUBLICATIONS

Office Action of U.S. Appl. No. 15/664,795 dated Jun. 15, 2020, 14 pages.

Notice of Allowance of U.S. Appl. No. 15/664,795 dated Oct. 2, 2020, 9 pages.

Huan, T.N., Simon, P., Benayad, A., Guetaz, L., Artero, V., and Fontecave, M. "Cu/Cu2O Electrodes and CO2 Reduction to Formic Acid: Effects of Organic Additives on Surface Morphology and Activity." Chemistry-A European Journal. 2016, 22 (39), 14029-14035.

Nie, X., Griffin, G.L., Janik, M.J., Asthagiri, A. "Surface phases of Cu2O (111) under CO2 electrochemical reduction conditions." Catalysis Communications. 2014, 52, 88-91.

Qiao, J., Liu, Y., Hong, F., Zhang, J. "A review of catalysts for the electroreduction of carbon dioxide to produce low-carbon fuels." Chemical Society Reviews. 2014, 43 (2), 631-675.

Ren, D., Deng, Y., Handoko, A.D., Chen, C.S., Malkhandi, S., Yeo, B.S. "Selective electrochemical reduction of carbon dioxide to ethylene and ethanol on copper (I) oxide catalysts." ACS Catalysis. 2015, 5 (5), 2814-2821.

Andal. V., and Buvaneswari, G. "Effect of reducing agents in the conversion of Cu2O nanocolloid to Cu nanocolloid." Engineering Science and Technology, an International Journal. vol. 20, Issue 1, Feb. 2017, pp. 340-344.

Bao et al., "Shape-Dependent Reducibility of Cuprous Oxide Nanocrystals," J. Phys. Chem. C 2010, 114, 6676-6680.

Bugayong, Joel Niño Galvez, "Electrochemical Reduction of CO2 on Support Cu2O Catalysts" (2014). LSU Doctoral Dissertations. 2858. http://digitalcommons.lsu.edu/gradschool_dissertations/2858.

De Brito, J.F., da Silva, A.A., Cavalheiro, A.J., Zanoni, M.V.B. Evaluation of the Parameters Affecting the Photoelectrocatalytic Reduction of CO2 to CH3OH at Cu/Cu2O Electrode. Int. J. Electrochem. Sci. 2014, 9, 5961-5973.

Eilert, A.; Cavalca, F.; Roberts, F. S.; Osterwalder, J. r.; Liu, C.; Favaro, M.; Crumlin, E. J.; Ogasawara, H.; Friebel, D.; Pettersson, L. G. "Subsurface oxygen in oxide-derived copper electrocatalysts for carbon dioxide reduction." The journal of physical chemistry letters 2016, 8 (1), 285-290.

Gawande et al., "Cu and Cu-Based Nanoparticles: Synthesis and Applications in Catalysis," Chem. Rev. 2016, 116, 3722-3811.

Gou et al., "Solution-Phase Synthesis of Cu2O Nanocubes," 2003 American Chemical Society, Nano Letters, 2003, 3 (2), pp. 231-234.

Handoko, A.D., and Tang, J. "Controllable proton and CO2 photoreduction over Cu2O with various morphologies." International Journal of Hydrogen Energy. vol. 38, Issue 29, Sep. 30, 2013, pp. 13017-13022.

Hori, Y.; Koga, O.; Yamazaki, H.; Matsuo, T. "Infrared spectroscopy of adsorbed CO and intermediate species in electrochemical reduction of CO2 to hydrocarbons on a Cu electrode." Electrochimica acta 1995, 40 (16), 2617-2622.

Hua et al., "Crystal Plane-Dependent Compositional and Structural Evolution of Uniform Cu2O Nanocrystals in Aqueous Ammonia Solutions," J. Phys. Chem. C 2011, 115, 201618-20627.

Qing Hua et al., "Morphological Evolution of Cu2O Nanocrystals in an Acid Solution: Stability of Different Crystal Planes", Langmuir, vol. 27, No. 2, Jan. 18, 2011, pp. 665-671.

Janáky, C., Hursán, D., Endrodi, B., Chanmanee, W., Roy, D., Liu, D., de Tacconi, N., Dennis, B.H., Rajeshwar, K. "Electro-and photoreduction of carbon dioxide: The twain shall meet at copper oxide/copper interfaces." ACS Energy Letters. 2016, 1 (2), 332-338.

Jewell, E., Hernandez, E., and Macdonald, J.E. "Photdegradation study of Copper (I) Oxide nanoparticles synthesized with different geometries." https://www.vanderbilt.edu/vinse/docs/NSF-REU-Erik-Jewell- Poster.pdf.

Kas, R., Kortlever, R., Milbrat, A., Koper, M.T., Mul, G., Baltrusaitis, J. "Electrochemical CO 2 reduction on Cu2O-derived copper nanoparticles: Controlling the catalytic selectivity of hydrocarbons." Physical Chemistry Chemical Physics. 2014, 16(24), 12194-12201.

Kauffman, D. R., Ohodnicki, P.R., Kail, B.W., Matranga, C. "Selective electrocatalytic activity of ligand stabilized copper oxide nanoparticles." The Journal of Physical Chemistry Letters. 2011, 2(16), 2038-2043.

Kim, D.; Kley, C. S.; Li, Y.; Yang, P. "Copper nanoparticle ensembles for selective electroreduction of CO2 to C2—C3 products." Proceedings of the National Academy of Sciences 2017, 114 (40), 10560-10565.

Kuhl, K. P.; Cave, E. R.; Abram, D. N.; Jaramillo, T. F. "New insights into the electrochemical reduction of carbon dioxide on metallic copper surfaces." Energy & Environmental Science 2012, 5 (5), 7050-7059.

Kuo et al., "Fabrication of Truncated Rhombic Dodecahedral Cu2O Nanocages and Nanoframes by Particle Aggregation and Acid Etching," J Am. Chem Soc. 2008, 130, 12815-12820.

Kuo et al., "Seed-Mediated Synthesis of Monodispersed Cu2O Nanocubes with Five Different Size Ranges from 40 to 420 nm," Adv. Func t. Mater. 2007, 17, 3773-3780.

LaGrow, A., Ward, M., Lloyd, D., Gai, P., and Boyes, E.D. "Visualizing the Cu/Cu2O Interface Transition in Nanoparticles with Environmental Scanning Transmission Electron Microscopy." Journal of the American Chemical Society. 2017, 139, pp. 179-185.

Le, M., Ren, M., Zhang, Z., Sprunger, P.T., Kurtz, R. L., Flake, J.C. "Electrochemical reduction of CO2 to CH3OH at copper oxide surfaces" Journal of the Electrochemical Society. 2011, 158 5), E45-E49.

Li, C.W., Kanan, M.W. "CO2 reduction at low overpotential on Cu electrodes resulting from the reduction of thick Cu2O films." Journal of the American Chemical Society. 2012, 134 (17), 7231-7234.

Liang, Y., Shang, L., Bian, T., Zhou, C., Zhang, D., Yu, H., Xu, H., Shi, Z., Zhang, T., Wu, L., and Tung, C. "Shape-controlled synthesis of polyhedral 50-facet Cu2O microcrystals with high-index facets." CrystEngComm. 14(13): 4431-4436, Jun. 2012.

Lum, Y., Yue, B., Lobaccaro, P., Bell, A.T., Ager, J.W. "Optimizing C—C coupling on oxide-derived copper catalysts for electrochemical CO2 reduction." The Journal of Physical Chemistry C. 2017, 121 (26), 14191-14203.

Ma, M., Djanashvili, K., Smith, W.A. "Selective electrochemical reduction of CO 2 to CO on CuO-derived Cu nanowires." Physical Chemistry Chemical Physics. 2015, 17 (32), 20861-20867.

Magdassi, S., Grouchko, M. and Kamyshny, A. "Copper Nanoparticles for Printed Electronics: Routes Towards Achieving Oxidation Stability." Materials. 2010, 3(9), 4626-4638.

T. Pal and J. Pal. "Faceted Metal and Metal Oxide Nanoparticles: Design, Fabrication and Catalysis". Nanoscale. 7(34) Jul. 2015.

Pérez-Gallent, E.; Marcandalli, G.; Figueiredo, M. C.; Calle-Vallejo, F.; Koper, M. T. "Structure-and Potential-Dependent Cation Effects on CO Reduction at Copper Single-Crystal Electrodes." Journal of the American Chemical Society 2017, 139 (45), 16412-16419.

Roberts, F.S., Kuhl, K.P., Nilsson, A. "Electroreduction of carbon monoxide over a copper nanocube catalyst: surface structure and pH dependence on selectivity." ChemCatChem. 2016, 8 (6), 1119-1124.

(56) References Cited

OTHER PUBLICATIONS

Wang, L., Gupta, K., Goodall, J.B., Darr, J.A., Holt, K. B. "In situ spectroscopic monitoring of CO2 reduction at copper oxide electrode." Faraday discussions. 2017, 197, 517-532.
Wang, G., Sun, H., Ding, L., Zhou, G. and Wang, Z. "Growth of Cu particles on a Cu2O truncated octahedron: tuning of the Cu content for efficient glucose sensing. " Physical Chemistry Chemical Physics. Issue 37, 2015.
Wang, X., Varela, A.S., Bergmann, A., Kuehl, S., Strasser, P. "Catalyst particle density controls hydrocarbon product selectivity in CO2 electroreduction on CuOx." ChemSusChem. 2017.
Zhang, Y., Deng, B., Zhang, T., Gao, D. and Xu, A. "Shape Effects of Cu2O Polyhedral Microcrystals on Photocatalytic Activity." J. Phys. Chem. C. 2010, 114, 11, 5073-5079.
Dong-Feng Zhang et al., "Delicate control of crystallographic facet-oriented Cu2O nanocrystals and the correlated adsorption ability", Journal of Materials Chemistry, vol. 19, No. 29, Jan. 1, 2009, pp. 5220-5225.
Extended European Search Report of European Serial No. 18186469.5 dated Dec. 3, 2018, 8 pages.
Office Action of U.S. Appl. No. 15/664,795 dated Jan. 28, 2020, 9 pages.
Aslam, Mohammed, et al., "Formation of Cu and Cu2O nanoparticles by variation of the surface ligand: preparation, structure, and insulating-to-metallic transition." Journal of colloid and interface science 255.1 (2002): 79-90.
Luo, Xiaolin, et al., "Sonochemical synthesis of porous Cu2O-Cu hollow spheres and their photo-catalysis." Materials Chemistry and Physics .151 (2015): 252-258.
Ping, Tao, et al., "Enhanced photocatalytic activity of Cu2O/Cu heterogeneous nanoparticles synthesized in aqueous colloidal solutions on degradation of methyl orange." Rare Metal Materials and Engineeering. 45.9 (2016): 2214-2218.
Office Action of U.S. Appl. No. 15/664,795 dated Jul. 29, 2019, 13 pages.
Yang, Ai-ling, et al. "Fabrication of Cu2O@ Cu2O core-shell nanaoparticles and conversion to Cu2O@ Cu core-shell nanoparticles in solution." Transactions of Nonferrous Metals Society of China 25.11 (2015): 3643-3650.
Zhang, Qiu-li, Yang, Zhi-Mao, Ding, Bing-jun, Lan, Xin-zhe, and Guo, Ying-juan., "Preparation of copper nanoparticles by chemical reduction method using potassium borohydride", Trans. Nonferrous Met. Soc. China 20(2010) s240-S244.
Zhang, M. & Huo, D. & Sun, X.-D & Kang, Y. (2017). Preparation of Cu micro/nanoparticles with ascorbic acid by liquid phase reduction method. Zhongguo Youse Jinshu Xuebao/Chinese Journal of Nonferrous Metals. 27. 747-752. (Cited in Chinese Office Action and Search Report of CN201810859393.X dated Nov. 10, 2021 with English translation).
Chinese Office Action and Search Report of CN201810859393.X dated Nov. 10, 2021, 6 pages.
Huang et al., 'Synthesis of Cu2O Nanocrystals from Cubic to Rhombic Dodecahedral Structures and Their Comparative Photocatalytic Activity', Journal of the American Chemical Society, vol. 134, Dec. 14, 2011 (Dec. 14, 2011), pp. 1261-1267.
Lee et al., 'Electrocatalytic Production of C3-C4 Compounds by Conversion of CO2 on a Chloride-Induced Bi-Phasic Cu2O-Cu Catalyst', Angewandte Chemie Interantional Edition, vol. 54, Oct. 16, 2015 (Oct. 16, 2015), pp. 14701-14705 and associated Supporting Information.
Sun et al., 'Facet-selective growth of Cu-Cu2O heterogeneous architectures', CrystalEngComm, vol. 14, Sep. 20, 2011 (Sep. 20, 2011), pp. 40-43 and associated Electronic Supplementary Information.
Wang et al., 'Selectivity on Etching: Creation of High-Energy Facets on Copper Nanocrystals for CO2 Electrochemical Reduction', ACS Nano, vol. 10, Mar. 14, 2016 (Mar. 14, 2016), pp. 4559-4564.
International Search Report and Written Opinion of PCT/US2020/019814 dated May 22, 2020, 13 pages.

* cited by examiner

SYNERGISTIC EFFECTS OF MULTI-FACETED CU2O NANOCRYSTALS FOR ELECTROCHEMICAL CO2 REDUCTION

CROSS REFERENCE TO RELATED APPLICATION

This application claims priority to U.S. Provisional Patent Application Ser. No. 62/811,708 filed Feb. 28, 2019, which is expressly incorporated herein by reference.

BACKGROUND

Cuprous oxide ($Cu_2O$; copper (I) oxide) is known to be one of the electro-catalysts capable of converting $CO_2$ to value-added products, by coupling with hydrogen in a process of electrochemical $CO_2$ reduction. However, $Cu_2O$ in the form of single-faceted crystals is not an ideal catalyst for $CO_2$ conversion. A single-faceted crystal is referred to as a crystal particle in which the crystal lattice is continuous and unbroken to the edges of the crystal, with no grain boundaries, and the facets all having the same Miller index (La the facets are all of the same type of facet).

Previous studies of $CO_2$ conversion have focused on single-faceted crystals of $Cu_2O$ as a conversion catalyst. However, single-faceted $Cu_2O$ crystals do not efficiently convert $CO_2$.

BRIEF DESCRIPTION

According to one aspect, a method of electrochemical reduction of carbon dioxide or carbonate ions ($CO_3^{-2}$) includes providing an electrochemical cell including an anode, and a cathode including crystals of multi-faceted copper (I) oxide; introducing an aqueous medium containing carbon dioxide or $CO_3^{-2}$ into the cell; and reducing the carbon dioxide or $CO_3^{-2}$ by contacting the crystals with the aqueous medium while supplying electricity to the cell.

According to another aspect, electrochemical cell for the electrochemical reduction of carbon dioxide or carbonate ions includes an anode; a cathode including crystals of multi-faceted copper (I) oxide; an electrolyte arranged between the anode and the cathode; and an aqueous medium containing carbon dioxide or $CO_3^{-2}$ in contact with the cathode

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
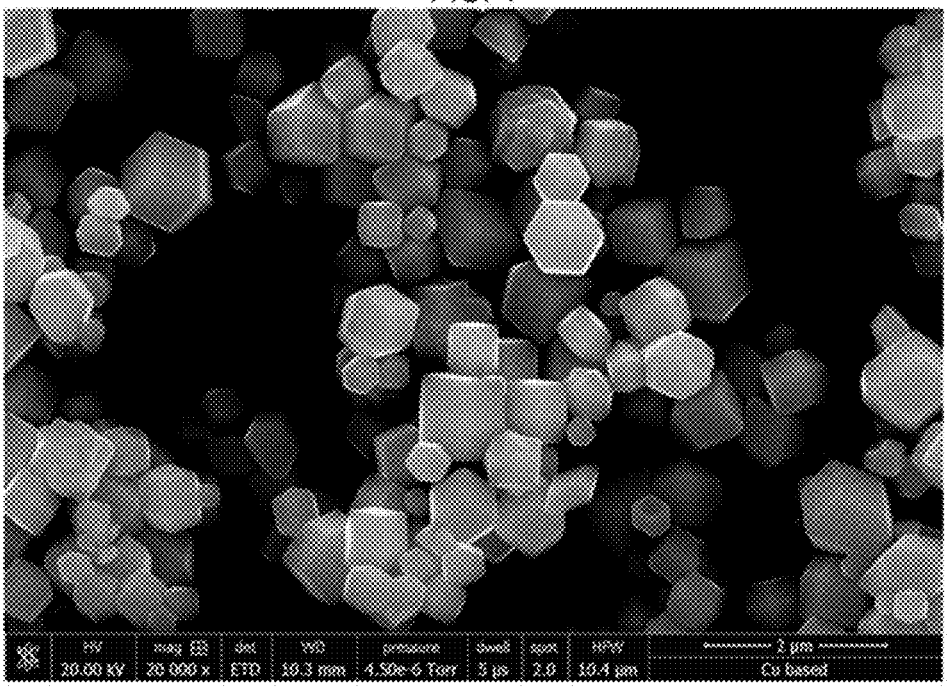
FIG. 1 is an SEM image of single-faceted $Cu_2O$ crystals.

In order to improve the conversion efficiency of $CO_2$, multi-faceted $Cu_2O$ crystals (e.g. nanocrystals) are proposed to be used as a catalyst for the reduction of $CO_2$ in an electrochemical cell. As used herein "multi-faceted" refers to crystals including facets having at least two different Miller indices (i.e. having at least two different types of facets). In this invention, multi-faceted crystals of $Cu_2O$ provide a synergistic effect when used in the conversion of $CO_2$ as compared to single-faceted crystal structures. The synergistic effect is produce by the steps and kinks between facets of different types on the $Cu_2O$ crystals, with the steps and kinks producing an increase in the Faradaic Efficiency in the conversion of $CO_2$ by electrochemical reduction to value-added products such as ethylene glycol, formic acid (HCOOH), methanol ($CH_3OH$), ethylene ($C_2H_4$), methane ($CH_4$), ethane ($C_2H_6$), ethanol, carbon monoxide (CO), acetic acid, acetone, other organic compounds, or combinations thereof.

Multi-faceted $Cu_2O$ crystals may be more effective for the electrochemical reduction of $CO_2$ due to the presence of these steps and kinks between the two different types of facets in the crystals. The steps and kinks are surface defects that arise in the transition between the two different types of facets in the crystals. These steps and kinks may provide more active sites for the electrochemical reduction of $CO_2$, and may thus have more active sites compared to single-faceted crystals, which do not have transitions between different types of facets, but instead only have transitions between facets of the same type. Steps and kinks are surface defects, which may play an important role in the chemical reactivity of the surface of the crystals. The advantages of the multi-faceted $Cu_2O$ crystals is the presence of these steps and kinks, which may provide 1) more active sites than single-faceted $Cu_2O$ single crystals alone; and 2) greater surface areas for electro-reduction, as compared with traditional single-faceted crystals, both of which may increase the Faradaic Efficiency in the conversion of $CO_2$ by electrochemical reduction as compared to single-faceted $Cu_2O$ crystals.

In this invention, multi-faceted $Cu_2O$ crystals are used as a catalyst for the electrochemical conversion of $CO_2$ to form an organic feedstock, including for example, formic acid, methanol, ethylene, methane, carbon monoxide, ethylene glycol, acetic acid, ethanol, acetone, other hydrocarbons, other organic compounds, or combinations thereof.

The use of multi-faceted crystals as a catalyst for the reduction of $CO_2$, is not limited to such use, and these crystals may be used in other electrochemical reactions. Further, the use of multi-faceted crystals as a catalyst is not limited to the use of multi-faceted $Cu_2O$ crystals, and can include the use of other multi-faceted particles including, for example, multi-faceted crystals of metals such as Cu, Ag, Au, Pt, Rh and Zn metals, metal alloys, and metal oxides as catalysts for the electrochemical reduction of $CO_2$ or other electrochemical conversions.

The conversion of $CO_2$ by electrochemical reduction may be performed using an electrochemical cell. The electrochemical cell may include an anode, a cathode including crystals of multi-faceted copper (I) oxide, an electrolyte arranged between the anode and the cathode, carbon dioxide or carbonate ions ($CO_3^{-2}$) in contact with the cathode, and other known components. The carbon dioxide may be included (such as by bubbling) in an aqueous medium and introduced into the electrochemical cell in contact with the cathode. Alternatively, the aqueous medium may include $CO_3^{-2}$, which may be produced by dissolving carbon dioxide in a basic aqueous solution, such as aqueous sodium hydroxide. The carbon dioxide or $CO_3^{-2}$ may be introduced into electrochemical cell via the aqueous medium, and reduced by contacting the multi-faceted copper (I) oxide crystals with the aqueous medium while supplying electricity to the cell. The multi-faceted $Cu_2O$ crystals may be arranged on a surface of the cathode so as to contact the aqueous medium.

By the electrochemical cell including the multi-faceted copper (I) oxide crystals in the cathode, the Faradaic Efficiency of $CO_2$ conversion by the electrochemical cell may be increased compared to electrochemical cells including cathodes having only single-faceted $Cu_2O$ crystals.

The multi-faceted $Cu_2O$ crystals may include two, three or more different types of facets. The multi-faceted crystals may have an average size (i.e. D50) of 10 nm to 5 μm, 10 nm to 1 μm, 10 nm to 500 nm, or 10 nm to 50 nm.

The multi-faceted $Cu_2O$ crystals may be, for example, 18-facet $Cu_2O$ crystals (FIGS. 5-8); 20-facet $Cu_2O$ crystals (FIGS. 9-12); or crystals with other numbers of facets, e.g. 50-facet crystals (FIGS. 13-17), or combinations of two or more distinct populations of multi-faceted $Cu_2O$ crystals (e.g. a combination of 18-facet, 20-facet crystals, and 50-facet crystals). The number of facets and the number of different types of facets in the crystals is not limited by the present subject matter. A ratio of copper to oxygen in the crystals may be from 3:1 to 1.9:1.

Figure 6:
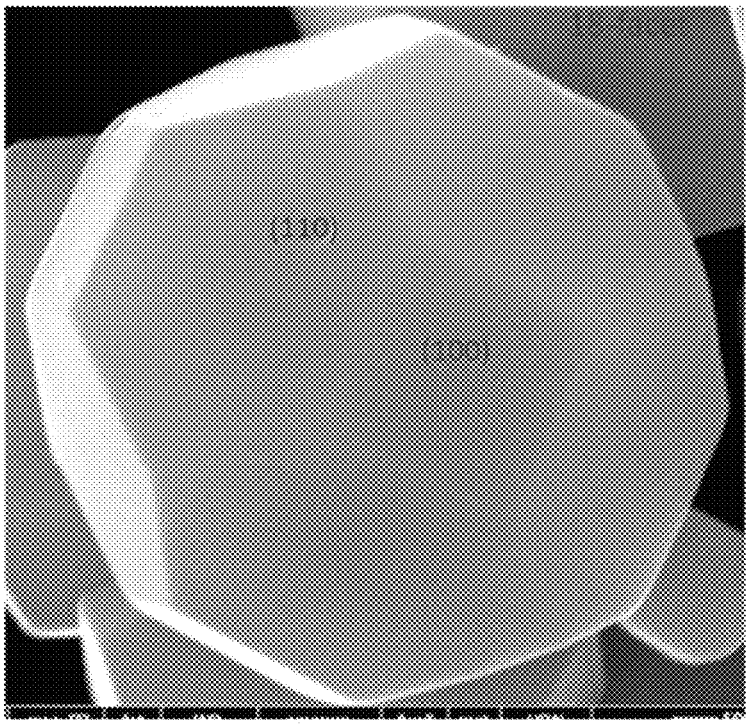
FIG. 6 is close up SEM image of the multi-faceted $Cu_2O$ crystals of FIG. 5.

The 18-facet crystals may include (110) facets and (100) facets as seen in FIG. 6. The 18-facet crystals may include six square-shaped (100) facets, and twelve hexagonal-shaped (110) facets. A ratio of the (110) facets to the (100) facets may be from 2.1:1 to 1.9:1. A ratio of copper to oxygen in the 18-facet crystals may be from 2.4:1 to 2:1.

Figure 10:
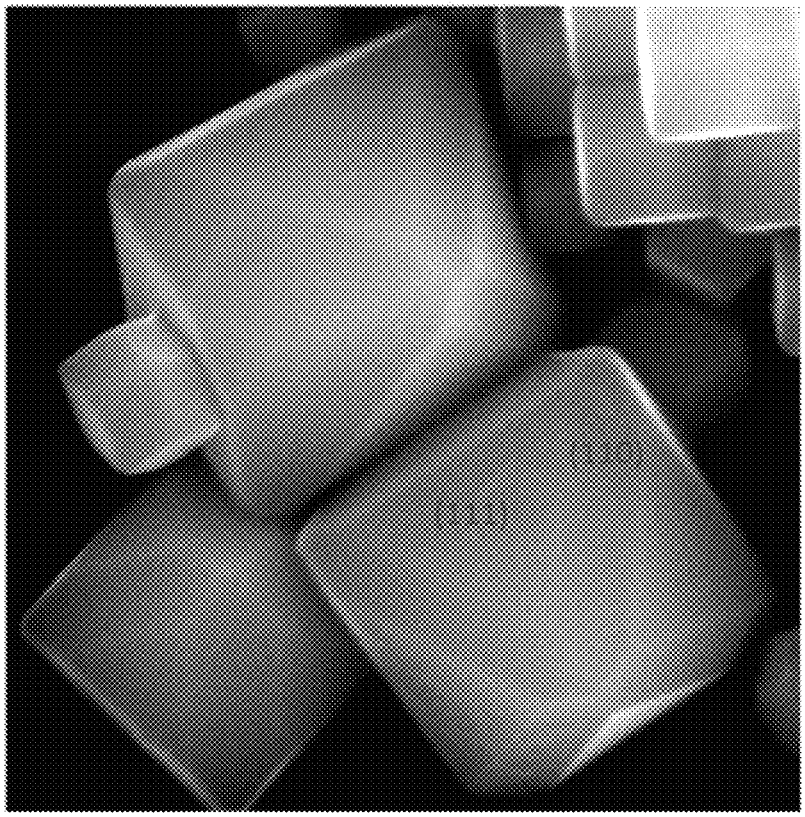
FIG. 10 is close up SEM image of the multi-faceted $Cu_2O$ crystals of FIG. 9.

The 20-facet $Cu_2O$ crystals may include (111) facets and (110) facets as seen in FIG. 10. The 20-facet crystals may include eight triangle-shaped (111) facets, and twelve elongated hexagon-shaped (110) facets. A ratio of the (110) facets to the (111) facets may be from 3.1:2 to 2.9:2. A ratio of copper to oxygen in the 20-facet crystals may be from 2.8:1 to 2.4:1.

Figure 15:
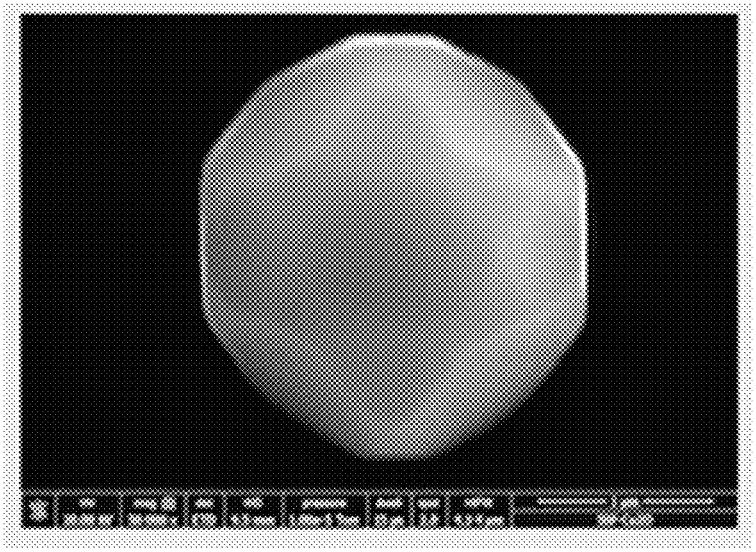
FIG. 15 is close up SEM image of a multi-faceted $Cu_2O$ crystal of FIG. 13.

The 50-facet $Cu_2O$ crystals may include (100) facets, (111) facets, (110) facets and (311) facets as seen in FIG. 15. The 50-facet crystals may include six (100) facets, eight (111) facets, twelve (110) facets and twenty-four (311) facets. A ratio of copper to oxygen in the 20-facet crystals may be from 2.8:1 to 2:1.

The multi-faceted $Cu_2O$ crystals may have a high quality, which means that they are substantially uniform in shape, where substantially all (e.g. over 90%) of the crystals in a certain population include the same types of facets, and are free of other types of facets not shared by all the crystals in the particular population. By "substantially free" of other types of facets, it is meant that the crystals in a certain population include less than 5% by surface area of other types of facets not shared by all the crystals in the population. For the 18-facet crystals for example, these crystals may only include facets other than the (110) facets and the (100) facets at an amount less than 5% by surface area of the crystals. For the 20-facet crystals for example, these crystals may only include facets other than the (111) facets and the (110) facets at an amount less than 5% by surface area of the crystals.

The multi-faceted crystals may be produced by any reaction method, or may be naturally occurring. A reaction method may be performed at a predetermined temperature using a wet chemical process including a reaction mixture of raw materials.

The 18-facet $Cu_2O$ crystals may be synthesized for example, by a method including forming a solution including a copper ion contributor dissolved in a solvent; adding a pH adjuster to the solution, wherein the solution has a pH of from 2-12; heating the solution to a first predetermined temperature of from 55-65° C. and agitated the solution until a precipitate forms in the solution; adding a reducing agent to the solution to thereby form a reaction mixture; and reacting the reaction mixture at a second predetermined temperature that is greater than the first predetermined temperature, and that ranges from 60° C. to 70° C., to thereby precipitate the 18-facet crystals from the reaction mixture.

The 20-facet $Cu_2O$ crystals may be produced by a method including forming a solution including a copper ion contributor and a capping agent dissolved in a solvent; heating the solution to a predetermined temperature of from 95° C. to 105° C.; adding a pH adjuster to the solution; adding a reducing agent to the solution to thereby form a reaction mixture; and reacting the reaction mixture at the predetermined temperature to thereby precipitate the 20-facet crystals.

The solvent may be used to dissolve the other raw materials so that a wet chemical reaction can proceed between the reactants. The solvent may include any liquid capable of solubilizing the other raw materials, and can include tap or deionized water, aqueous ammonia solutions, or an organic solvent such as methanol, ethanol, acetone, ether, or glycerol for example. In one non-limiting embodiment, the solvent includes deionized water.

The copper ion contributor may be any substance that is capable of contributing copper ions ($Cu^{2+}$), including for example, a copper salt or hydrate thereof. The copper salt can include for example copper (II) chloride ($CuCl_2$), copper (II) fluoride ($CuF_2$), copper (II) chloride ($CuCl_2$), copper (II) bromide ($CuBr_2$), copper (II) iodide ($CuI_2$), cuprous iodide (CuI), copper (II) oxide (CuO), copper (II) sulfide (CuS), copper (II) sulfate ($CuSO_4$), copper (II) nitride ($Cu_3N_2$), copper(II) nitrate ($Cu(NO_3)_2$), copper (II) phosphide ($Cu_3P_2$), copper (II) acetate ($Cu(CH_3COO)_2$), copper (II) hydroxide ($CuOH)_2$, copper(II) carbonate ($CuCO_3$), and copper (II) acetylacetonate ($Cu(C_5H_7O_2)_2$), or combinations thereof. In some non-limiting examples, the copper ion contributor includes one or more of copper (II) chloride dihydrate ($CuCl_2.2H_2O$), copper (II) acetate hydrate ($Cu(CH_3COO)_2.H_2O$), or copper (II) sulfate hydrate ($CuSO_4.5H_2O$, cupric sulfate pentahydrate).

The copper ion contributor can be added to the solvent as a solid that is then dissolved therein. The amount of the copper ion contributor used in the reaction is not critical, and the copper ion contributor can be included at an amount to provide a molar concentration (i.e. molarity) in the reaction mixture of 1-40 millimoles (mmol) of copper ion contributor per liter (L) of reaction mixture, i.e. mmol/L or millimolar (mM). The copper ion contributor may also be included to provide a molar concentration of 5-15 mM, or 9-11 mM, or 10 mM in the reaction mixture. In one non-limiting example, the copper ion contributor is copper (II) acetate hydrate, and is included in an amount to provide a molar concentration of 36-37 mM in the reaction mixture to synthesize 18-facet $Cu_2O$ crystals. In one non-limiting example, the copper ion contributor is cupric sulfate pentahydrate, and is included in an amount to provide a molar concentration of 9-10 mM in the reaction mixture to synthesize 20-facet $Cu_2O$ crystals.

The materials used in synthesizing $Cu_2O$ crystals may also include a capping agent, which is used to stabilize the crystals and control the crystal growth. The capping agent may include for example, polyvinylpyrrolidone (PVP), plant-derived extracts such as those from *Terminalia arjuna*, ethylene glycol, oleic acid, sodium laureth sulfate, sodium metaphosphate, oleylamine, dodecylbenzenesulfonic acid, ethylene diamine, triphenylphosphine oxide, peracetic acid, polyethylene glycol, fructose, tetramethylammonium hydroxide, and amino acids such as L-arginine.

The capping agent may be added to the solvent as a solid for dissolution therein. The amount of capping agent used in the reaction is not critical, and the capping agent can be included at an amount to provide a molar concentration of 0.01-150 mM, 10-100 mM, or 4-60 mM in the reaction mixture. In one non-limiting example, a capping agent is not used in the reaction mixture to synthesize 18-facet $Cu_2O$ crystals. In another non-limiting example, the capping agent is oleic acid, and is included in an amount to provide a molar concentration of 120-125 mM in the reaction mixture to synthesize 20-facet $Cu_2O$ crystals.

The materials used in synthesizing $Cu_2O$ crystals may also include a pH adjustor, which can include various acids, bases, or combinations thereof, such as sodium hydroxide (NaOH) or ammonia for example. The pH adjustor may be used to adjust the pH of the reaction mixture to be between 2.0 and 12.0. The pH adjustor may be introduced as a solid for dissolution in the solvent, or as a solution, such as an aqueous solution after the pH adjustor has been dissolved in water. In one non-limiting example, the pH adjustor includes sodium hydroxide, which may be introduced as an aqueous solution having a molar concentration of sodium hydroxide in the reaction mixture of 10-1000 mM. In one non-limiting aspect, a sodium hydroxide aqueous solution is introduced in an amount to provide a molar concentration of 820-830 mM in the reaction mixture to synthesize 18-facet $Cu_2O$ crystals. In another non-limiting aspect, a sodium hydroxide aqueous solution is introduced in an amount to provide a molar concentration of 70-80 mM in the reaction mixture to synthesize 20-facet $Cu_2O$ crystals.

The materials used in synthesizing $Cu_2O$ crystals may also include a reducing agent, which is included to donate electrons (by oxidation of the reducing agent) that are used for the reduction of the copper ions to produce $Cu_2O$ crystals. The reducing agent may include for example, L-ascorbic acid (i.e. vitamin C, or $C_6H_8O_6$), hydrazine monohydrate, sodium borohydride, hydrazine, 1,2-hexadecanediol, glucose, carbon monoxide, sulfur dioxide, iodides, hydrogen peroxide, oxalic acid, formic acid, carbon, reducing sugars, a borane compound, or combinations thereof.

The reducing agent may be added to the solvent as a solid for dissolution therein, or in a solution, such as an aqueous solution after the reducing agent has been dissolved in water. In one non-limiting example, the reducing agent is added to the solvent as a solution. The amount of the reducing agent used in the reaction is not critical and may be added to provide a molar concentration in the reaction mixture of 10-1000 mM, 20-500 mM, or 30-200 mM. In one non-limiting example, the reducing agent includes L-ascorbic acid, which may be introduced as an aqueous solution in an amount to provide a molar concentration of 20-40 mM in the reaction mixture to synthesize 18-facet $Cu_2O$ crystals. In another non-limiting example, the reducing agent includes glucose, which may be introduced as an aqueous solution in an amount to provide a molar concentration of 160-180 mM in the reaction mixture to synthesize 20-facet $Cu_2O$ crystals.

EXAMPLES

As inventive examples, three different multi-faceted $Cu_2O$ crystals were prepared in order to demonstrate the synergistic effects of multi-faceted $Cu_2O$ crystals in the electrochemical reduction of $CO_2$ for conversion. As a reference, a comparative example was prepared, including single-faceted crystals having 12-facets of the same type (110), such that the $Cu_2O$ crystals are fully enclosed by twelve (110) facets.

Three inventive examples of multi-faceted $Cu_2O$ crystals have been prepared, and include 18-facet $Cu_2O$ crystals fully enclosed by 12 (110) facets and 6 (100) facets (referred to herein as "18-facet" crystals, see FIGS. 5-8), 20-facet $Cu_2O$ crystals fully enclosed by 12 (110) facets and 8 (111) facets (referred to herein as "20-facet" crystals, see FIGS. 9-12), and 50-facet $Cu_2O$ crystals by 6 (100), 8 (111), 12 (110) facets and 24 (311) facets (referred to herein as "50-facet" crystals, see FIGS. 13-17). As should be understood, the 18-facet, 20-facet, and 50-facet crystals are "multi-faceted" because they each have two or more distinct types of facets enclosing the crystals, and thus have steps and kinks in the transitions between the two different types of facets.

Example 1

An inventive example of 18-facet $Cu_2O$ crystals was produced in accordance with the present subject matter. The 18-facet $Cu_2O$ crystals of Example 1 were synthesized by dissolving 0.7 g of $Cu(CH_3COO)_2.H_2O$ (copper ion contributor) in 70 ml of deionized water (solvent) in a 250 ml flask under constant electromagnetic stirring. The flask was kept in a 60° C. oil bath. 11.67 ml of 6.6 M NaOH aqueous solution (pH adjuster) was added dropwise into the above blue solution and kept stirring for 10 min. Once the NaOH was added, a precipitate formed and the solution gradually change in color to dark brown. Thereafter, 11.67 ml of 0.25 M vitamin C aqueous solution (reducing agent) was added to form a reaction mixture. The reaction mixture was heated to 65° C. for 12 min and a brownish-red product was produced. After the reaction time, the precipitate was separated from solution by centrifugation, washed with water and ethanol, and dried at 50° C. under vacuum for overnight.

Figure 5:
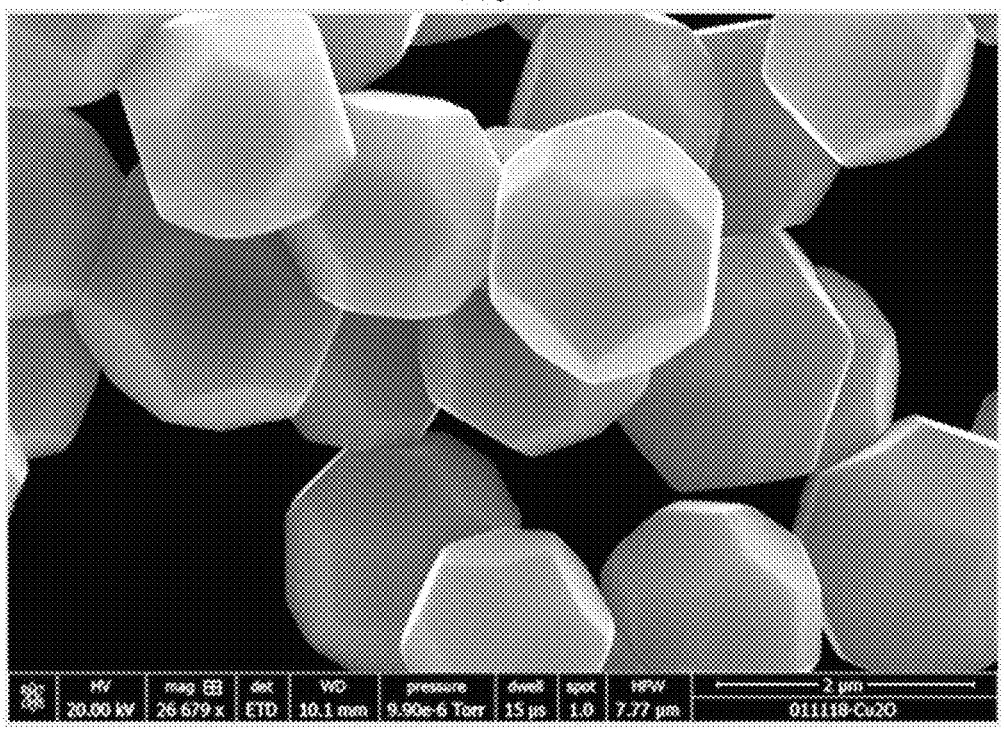
FIG. 5 is an SEM image of multi-faceted $Cu_2O$ crystals according to the present subject matter.
Figure 7:
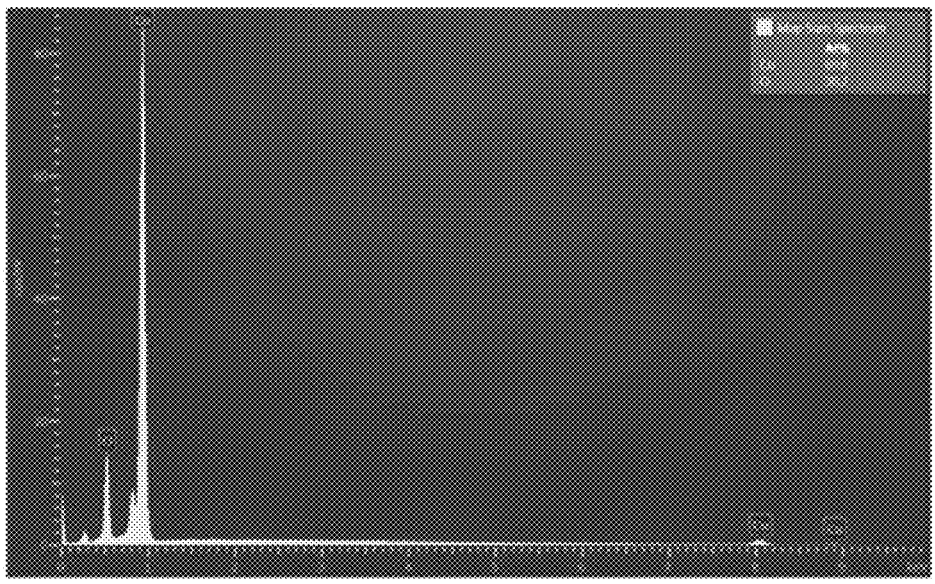
FIG. 7 is an EDS spectrum of the multi-faceted $Cu_2O$ crystals of FIG. 5.
Figure 8:
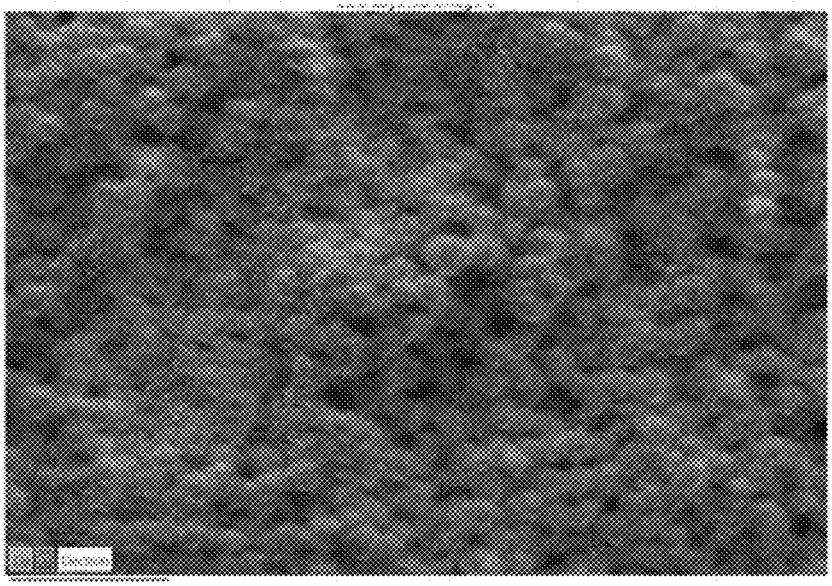
FIG. 8 is an EDS elemental mapping of the multi-faceted $Cu_2O$ crystals of FIG. 5.

FIGS. 5-6 show SEM images of the 18-facet polyhedral $Cu_2O$ crystals of Example 1. The crystal includes six square (100) facets and twelve hexagonal (110) facets, in which both surfaces and edges developed well. FIG. 7 shows an EDS (energy dispersive spectroscopy) spectrum and FIG. 8 shows an EDS elemental mapping of the 18-facet polyhedral $Cu_2O$ crystals of Example 1. The atomic percentage of Cu to O is a little more than 2 to 1 (Cu:O=69.8:30.2) as shown at the upper right of FIG. 7. The average size of the 18-facet $Cu_2O$ crystals is approximately 1 μm, but this average size can be easily reduced to tens of nanometers.

Example 2

An inventive example of 20-facet truncated octahedral $Cu_2O$ crystals was produced in accordance with the present subject matter. The 20-facet $Cu_2O$ crystals of Example 2 were synthesized by dissolving 1.5 mmol of $CuSO_4.5H_2O$ (copper ion contributor) in 60 ml deionized water (solvent) to form a light blue solution, followed by the addition of 30 ml ethanol (solvent) and 6 ml of oleic acid (capping agent) under vigorous stirring. The solution was heated to a temperature of 100° C., at which point 15 ml of sodium hydroxide aqueous solution (containing 12 mmol or 480 mg of NaOH) was added and stirred for 5-10 min. Finally, 45 ml of 0.6 M aqueous glucose solution (reducing agent) was added and stirred at 100° C. for 80 min. During the procedure, the color of the solution turned into light blue, dark blue and then brick-red. The resulting precipitate was collected by centrifugation and washed with ethanol 3 times and deionized $H_2O$ twice to remove unreacted chemicals, and finally dried at 40° C. in a vacuum oven for 6 h.

Figure 9:
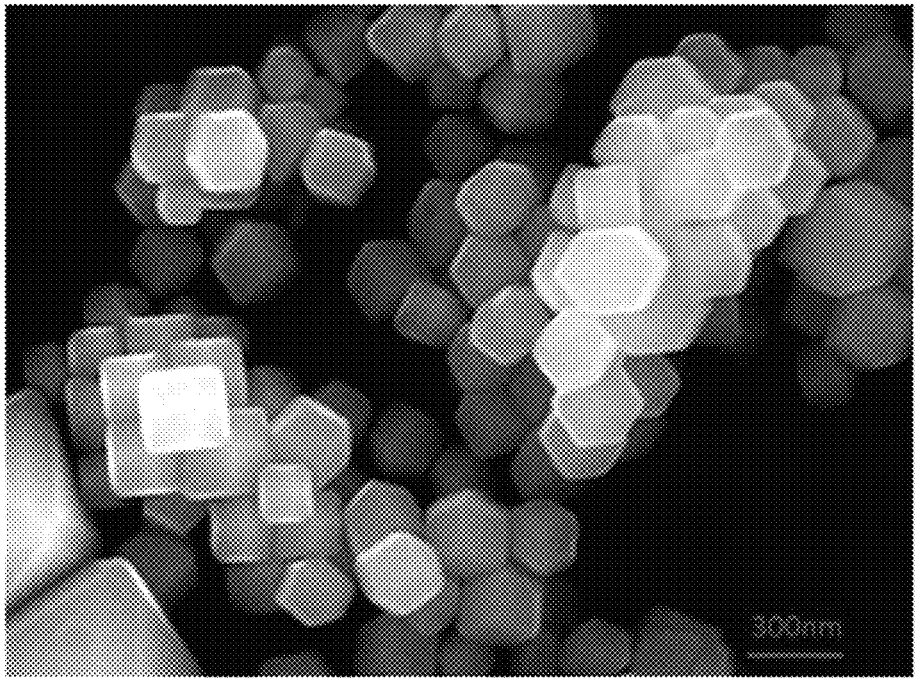
FIG. 9 is an SEM image of another multi-faceted $Cu_2O$ crystals according to the present subject matter.
Figure 11:
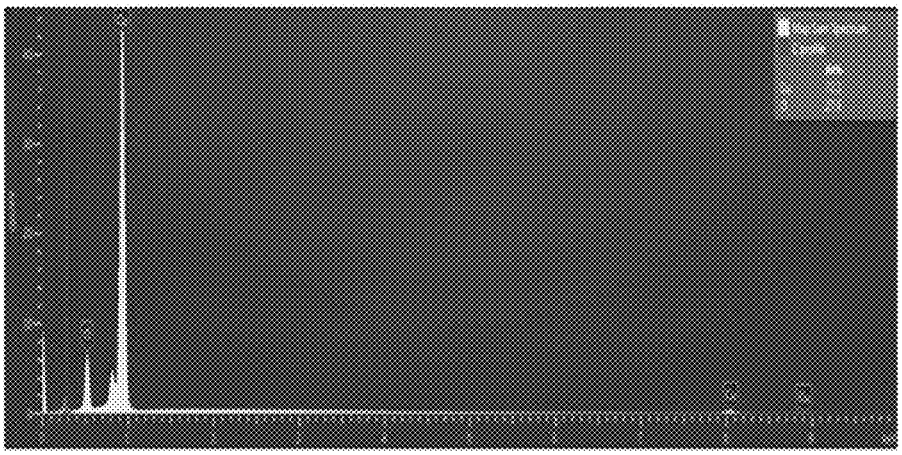
FIG. 11 is an EDS spectrum of the multi-faceted $Cu_2O$ crystals of FIG. 9.
Figure 12:
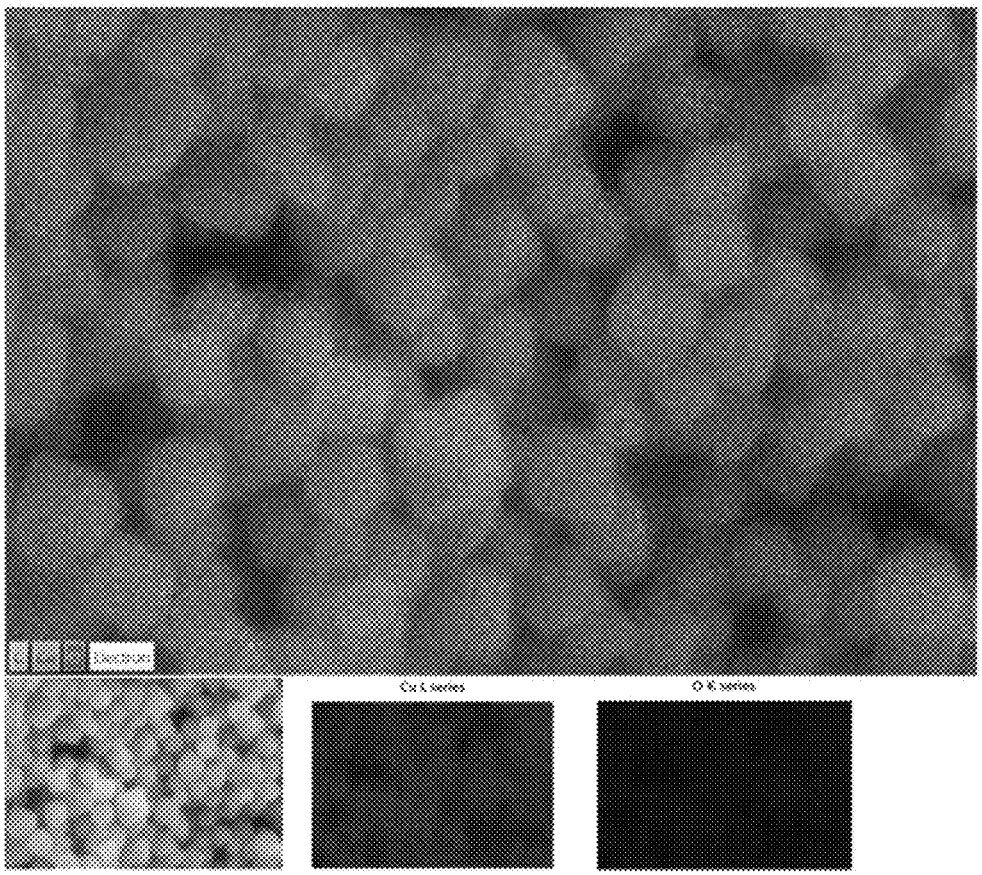
FIG. 12 is an EDS elemental mapping of the multi-faceted $Cu_2O$ crystals of FIG. 9.

FIGS. 9-10 show SEM images of the 20-facet truncated octahedral $Cu_2O$ crystals of Example 2. The crystal includes eight (111) facets and twelve (110) facets, in which both surfaces and edges developed well. FIG. 11 shows an EDS (energy dispersive spectroscopy) spectrum and FIG. 12 shows an EDS elemental mapping of the 20-facet truncated octahedral $Cu_2O$ crystals of Example 2. The atomic percentage of Cu to O is a little more than 3 to 1 (Cu:O=72.1:27.9) as shown at the upper right of FIG. 11. The average size of the 20-facet $Cu_2O$ crystals is approximately 300 nm, but this average size can be easily reduced to tens of nanometers.

Cupric sulfate pentahydrate [$CuSO_4.5H_2O$], oleic acid, D-(+)-glucose and sodium hydroxide were obtained from Sigma Aldrich. All of the chemicals were analytical grade and used without further purification.

Example 3

Figure 13:
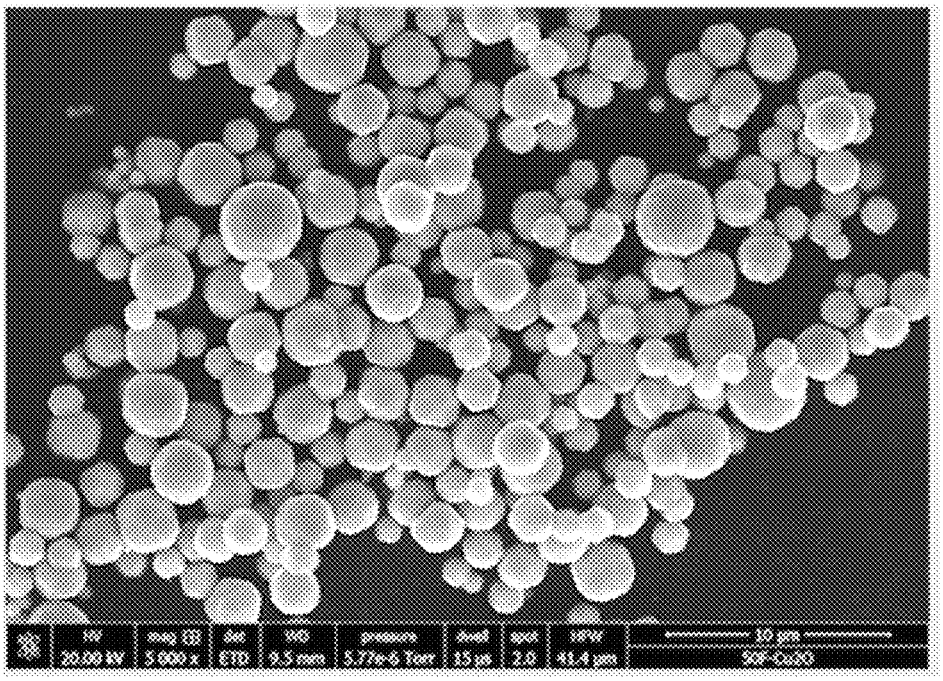
FIG. 13 is an SEM image of another multi-faceted $Cu_2O$ crystals according to the present subject matter.
Figure 14:
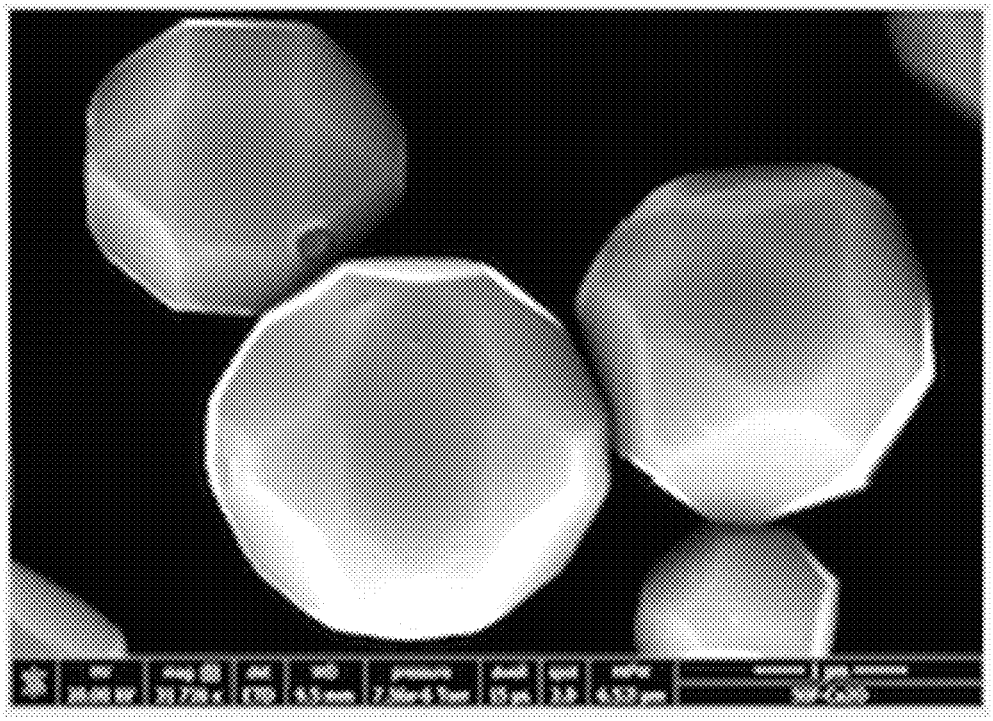
FIG. 14 is close up SEM image of the multi-faceted $Cu_2O$ crystals of FIG. 13.
Figure 16:
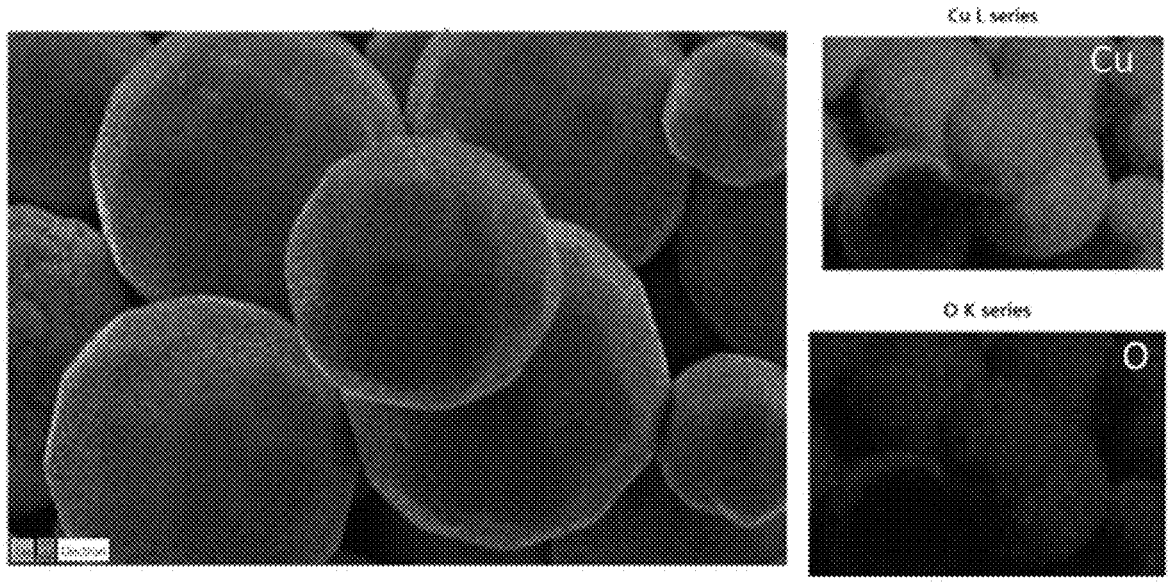
FIG. 16 is an EDS elemental mapping of the multi-faceted $Cu_2O$ crystals of FIG. 13.
Figure 17:
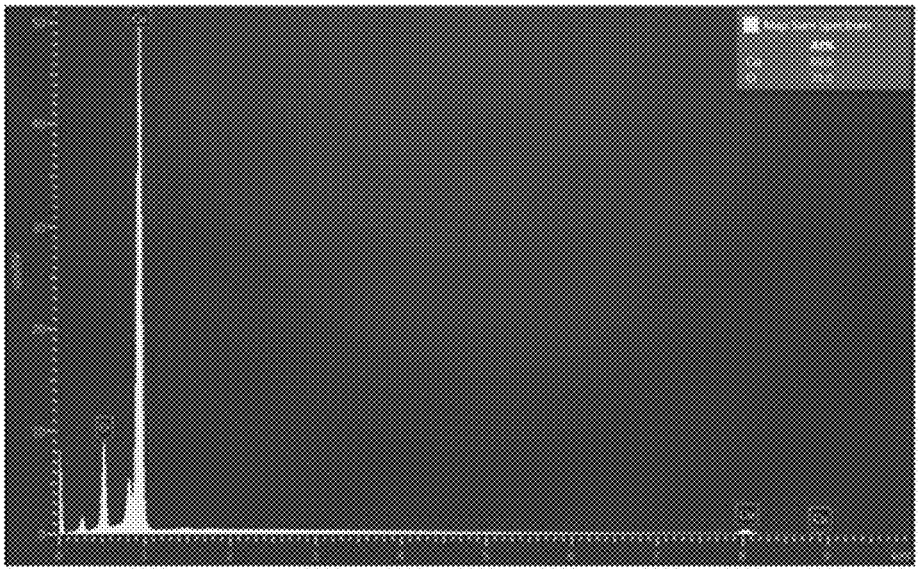
FIG. 17 is an EDS spectrum of the multi-faceted $Cu_2O$ crystals of FIG. 13.

50-facet $Cu_2O$ (FIGS. 13-17) crystals were made according to the present subject matter. FIG. 13-15 show SEM images of the crystals. FIG. 16 shows an EDS (energy dispersive spectroscopy) elemental mapping of the 50-facet $Cu_2O$ crystals. FIG. 17 shows an EDS spectrum of the 50-facet $Cu_2O$ crystals. The atomic percentage of Cu to O is a little more than 2 to 1 (Cu:O=69:31) as shown at the upper right of FIG. 17. The average size of the 50-facet $Cu_2O$ crystals is approximately 2 μm, but this average size can be easily reduced to tens of nanometers.

Comparative Example 1

A comparative example of single-faceted $Cu_2O$ crystals was produced to have twelve smooth facets of only a single type, i.e. only (110) facets. The 12-facet $Cu_2O$ crystals of Comparative Example 1 were synthesized by dissolving 1.5 mmol of $CuSO_4.5H_2O$ in 60 ml deionized water to form a light blue solution, followed by addition of 30 ml ethanol and 10.5 ml of oleic acid under vigorous stirring. The solution was heated to 100° C., after which 15 ml of sodium hydroxide aqueous solution (12 mmol, 480 mg) was added to the above mixture and stirred for 5-10 min. Finally, 45 ml of 0.6 M aqueous glucose solution was added and stirred at 100° C. for 80 min. During the procedure, the color of the solution turned into light blue, dark blue and brick-red. The resulting precipitate was collected by centrifugation and washed with ethanol 3 times and de-ionized deionized $H_2O$ twice to remove unreacted chemicals, and finally dried at 40° C. in a vacuum oven for 6 h.

Figure 2:
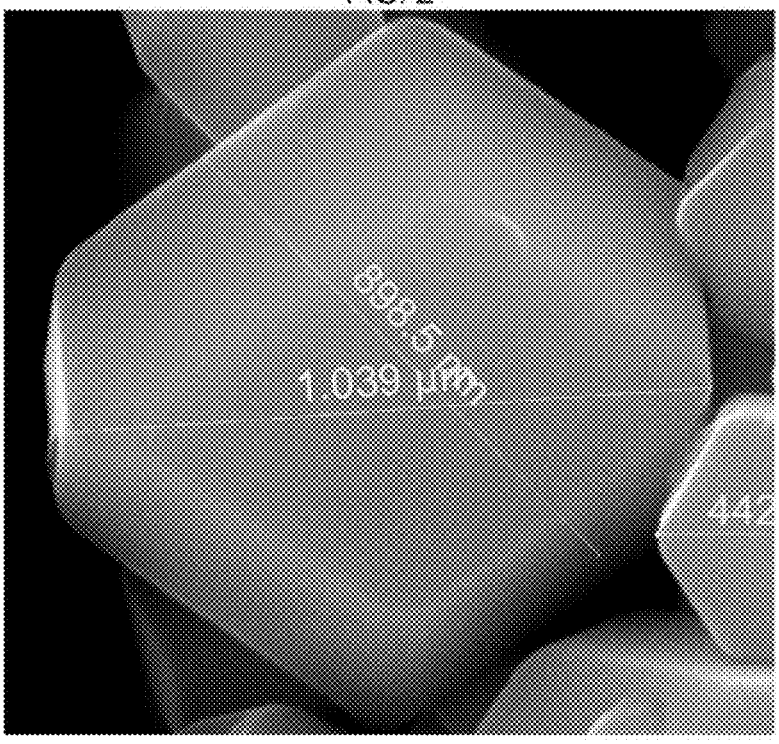
FIG. 2 is a close up SEM image of the single-faceted $Cu_2O$ crystals of FIG. 1.
Figure 3:
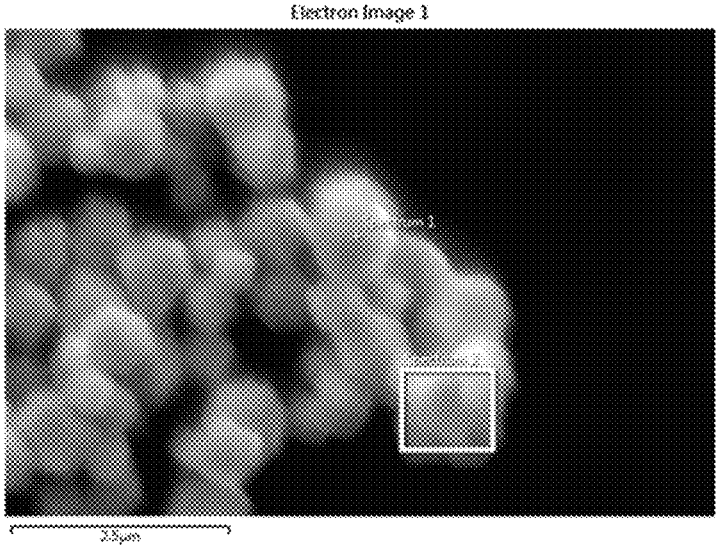
FIG. 3 is another SEM image of the single-faceted $Cu_2O$ crystals of FIG. 1.
Figure 4:
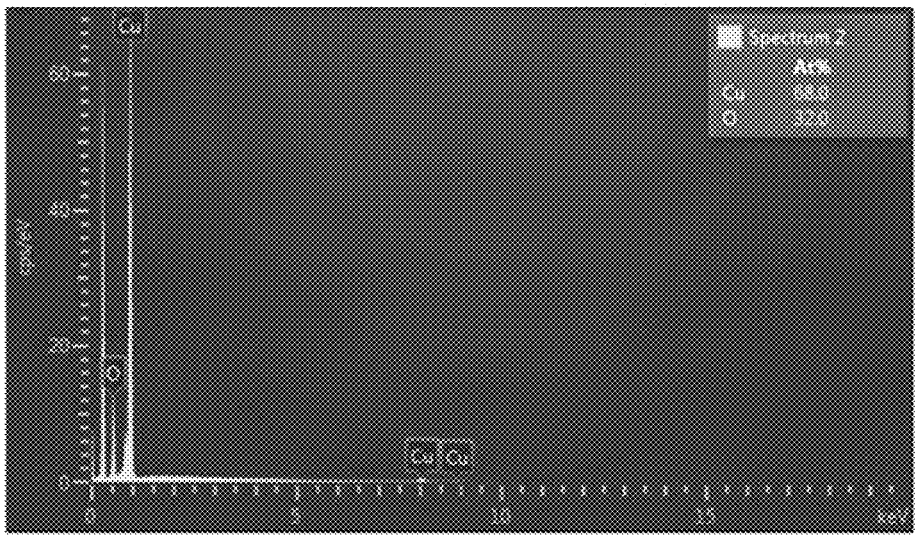
FIG. 4 is an EDS spectrum of the single-faceted $Cu_2O$ crystals of FIG. 1.

FIGS. 1-3 show SEM images of the 12-facet rhombic dodecahedral $Cu_2O$ crystals of Comparative Example 1. FIG. 4 shows an EDS (energy dispersive spectroscopy) spectrum of the 12-facet $Cu_2O$ crystals of Comparative Example 1. The atomic percentage of Cu to O is a little more than 2 to 1 (Cu:O=68:32) as shown at the upper right of FIG. 4. The average size of the 12-facet $Cu_2O$ crystals is approximately 1 μm.

The conversion efficiency of the $Cu_2O$ crystals of the above examples were evaluated by including the $Cu_2O$ crystals of the above examples separately in a cathode of an electrochemical cell. Carbon dioxide was in contact with the cathode and an electrical current was supplied to the cell to convert the $CO_2$ to value-added products.

One prominent feature of the electrochemical $CO_2$ reduction on $Cu_2O$ is that ethylene glycol, one of value-added products for fuel, is used as an indicator. Table 1 below shows the Faradaic Efficiency (FE) for $CO_2$ reduction of these three different $Cu_2O$ crystal examples for yielding various organic compounds as value-added products. Controlled potential coulometry experiments were conducted at −1.0V vs. Ag/AgCl for 1.5 h.

TABLE 1

| | Faradaic Efficiency (FE) Cathode - $Cu_2O$ Crystals | | | | |
|---|---|---|---|---|---|
| | Formic Acid (%) | Ethylene Glycol (%) | Acetic Acid (%) | Ethanol (%) | Acetone (%) |
| Comparative Example 1: 12-facet | 0.06 | .0258 | 0.21 | 0.55 | 0.15 |
| Example 1: 18-facet | 0.68 | 11.28 | 0.15 | 1.66 | 0.31 |
| Example 2: 20-facet | 0.17 | 6.32 | 0.29 | 2.03 | 0.24 |
| Example 3: 50-facet | 0 | 32.67 | 3.03 | 0 | 7.84 |

As can be seen, the 18-facet, 20 facet, and 50 facet $Cu_2O$ crystals, which are multi-faceted crystals including steps and kinks, have an FE of 11.28%, 6.32%, and 32.67%, respectively, for ethylene glycol production from the electrochemical reduction of $CO_2$. These FE values are over 100 times the FE value of 0.0258% for the 12-facet crystals, which are single-faceted crystals with no steps and kinks.

Although all three example $Cu_2O$ crystals include (110) facets, the multi-faceted crystals (18-facet and 20-facet crystals) having steps and kinks achieve a much higher electrochemical conversion of $CO_2$ than the single-faceted crystals of Comparative Example 1 due to the synergistic effects of steps and kinks of the multi-faceted $Cu_2O$ crystals of Examples 1 and 2.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of electrochemical reduction of carbon dioxide or $CO_3^{-2}$ including:

providing an electrochemical cell including an anode, and a cathode including crystals of multi-faceted copper (I) oxide having facets with at least two different Miller indices and with steps and kinks between facets of different Miller indices;

introducing an aqueous medium containing carbon dioxide or $CO_3^{-2}$ into the cell; and reducing the carbon dioxide or $CO_3^{-2}$ by contacting the crystals with the aqueous medium while supplying electricity to the cell;

wherein the crystals of multi-faceted copper (I) oxide include 18-facet crystals including (110) facets and (100) facets, 20-facet crystals including (111) facets and (110) facets, 50-facet crystals including (100) facets, (111) facets, (110) facets and (311) facets, or combinations thereof.

2. The method according to claim 1, wherein the carbon dioxide or $CO_3^{-2}$ is reduced to an organic feedstock including formic acid, methanol, ethylene, methane, carbon monoxide, ethylene glycol, acetic acid, ethanol, ethane, carbon monoxide, acetic acid, acetone, or combinations thereof.

3. The method according to claim 1, wherein the crystals of multi-faceted copper (I) oxide include the 18-facet crystals including (110) facets and (100) facets.

4. The method according to claim 3, further including preparing the 18-facet crystals by:

forming a solution including a copper ion contributor dissolved in a solvent;

adding a pH adjuster to the solution, wherein the solution has a pH of from 2-12;

heating the solution to a first predetermine temperature of from 55-65° C. and agitated the solution until a precipitate forms in the solution;

adding a reducing agent to the solution to thereby form a reaction mixture; and reacting the reaction mixture at a second predetermined temperature that is greater than the first predetermined temperature and ranges from 60° C. to 70° C., to thereby precipitate the 18-facet crystals from the reaction mixture.

5. The method according to claim 1, wherein the crystals of multi-faceted copper (I) oxide include the 20-facet crystals including (111) facets and (110) facets.

6. The method according to claim 5, further including preparing the 20-facet crystals by:

forming a solution including a copper ion contributor and a capping agent dissolved in a solvent;

heating the solution to a predetermined temperature of from 95° C. to 105° C.;

adding a pH adjuster to the solution;

adding a reducing agent to the solution to thereby form a reaction mixture; and reacting the reaction mixture at the predetermined temperature to thereby precipitate the 20-facet crystals.

7. The method according to claim 1, wherein the crystals have an average size of 10-500 nm.

8. The method according to claim 1, wherein the crystals of multi-faceted copper (I) oxide include the 50-facet crystals including (100) facets, (111) facets, (110) facets and (311) facets.

9. An electrochemical cell for electrochemical reduction of carbon dioxide or $CO_3^{-2}$ including:

an anode;

a cathode including crystals of multi-faceted copper (I) oxide having facets with at least two different Miller indices and with steps and kinks between facets of different Miller indices;

an electrolyte arranged between the anode and the cathode; and an aqueous medium containing carbon dioxide or $CO_3^{-2}$ in contact with the cathode;

wherein the crystals of multi-faceted copper (I) oxide include 18-facet crystals including (110) facets and (100) facets, 20-facet crystals including (111) facets and (110) facets, 50-facet crystals including (100) facets, (111) facets, (110) facets and (311) facets, or combinations thereof.

10. The cell according to claim 9, wherein the crystals include the 18-facet crystals including (110) facets and (100) facets.

11. The cell according to claim 10, wherein a ratio of the (110) facets to the (100) facets is from 2.1:1 to 1.9:1.

12. The cell according to claim 11, wherein the crystals include facets other than the (110) facets and the (100) facets at an amount less than 5% by surface area of the crystals.

13. The cell according to claim 10, wherein:

a ratio of copper to oxygen in the crystals is from 2.35:1 to 2:1; and an average size of the 18-facet crystals is 10 nm to 5 μm.

14. The cell according to claim 9, wherein:

the crystals include the 20-facet crystals including (110) facets and (111) facets; and a ratio of the (110) facets to the (111) facets is from 3.1:2 to 2.9:2.

15. The cell according to claim 14, wherein the crystals include facets other than the (110) facets and the (111) facets at an amount less than 5% by surface area of the crystals.

16. The cell according to claim 14, wherein:

a ratio of copper to oxygen in the crystals is from 2.6:1 to 2.3:1; and an average size of the 20-facet crystals is 10 nm to 5 μm.

17. The cell according to claim 9, wherein the crystals include the 50-facet crystals including (100) facets, (110) facets, (111) facets, and (311) facets.

18. The cell according to claim 17, wherein the 50-facet crystals include six (100) facets, twelve (110) facets, eight (111) facets, and twenty four (311) facets.

19. The cell according to claim 18, wherein the crystals include facets other than the 100) facets, (110) facets, (111) facets, and (311) facets at an amount less than 5% by surface area of the crystals.

20. The cell according to claim 18, wherein:

a ratio of copper to oxygen in the crystals is from 2.8:1 to 2:1; and an average size of the 50-facet crystals is 10 nm to 5 μm.

* * * * *